United States Patent [19]

Österman et al.

[11] Patent Number: 4,981,129

[45] Date of Patent: Jan. 1, 1991

[54] CHAIN SAW

[76] Inventors: Bror E. Österman, Styrmansgatan 52, S-114 00, Stockholm; Sture Andersson, Oskarsvägen 7, S-172 37, Sundbyberg, both of Sweden

[21] Appl. No.: 326,245

[22] PCT Filed: Aug. 27, 1987

[86] PCT No.: PCT/SE87/00379

§ 371 Date: Mar. 31, 1989

§ 102(e) Date: Mar. 31, 1989

[87] PCT Pub. No.: WO88/01559

PCT Pub. Date: Mar. 10, 1988

[30] Foreign Application Priority Data

Sep. 2, 1986 [SE] Sweden ..... 8603681

[51] Int. Cl.[5] ..... B28D 1/08

[52] U.S. Cl. ..... 125/21; 30/123.4; 30/384; 83/574

[58] Field of Search ..... 125/21, 22; 30/123.4, 30/383–387; 83/574, 796, 797, 816

[56] References Cited

U.S. PATENT DOCUMENTS

| | | | |
|---|---|---|---|
| 3,044,506 | 7/1962 | Oehrli | 30/123.4 |
| 3,545,422 | 12/1970 | McNulty | 125/21 |
| 4,361,960 | 12/1982 | Halverson | 30/123.4 |
| 4,382,334 | 5/1983 | Reynolds | 30/386 |

*Primary Examiner*—Hien H. Phan

*Attorney, Agent, or Firm*—Burns, Doane, Swecker & Mathis

[57] ABSTRACT

A chain saw has a chain bar (1) with a nose sprocket (5) over which a saw chain (3) circulates. The sprocket (5) is mounted between two nose cheek plates (53). The interior spacing between the plates corresponds to the thickness of the sprocket. The peripheral area of the sprocket with associated teeth at the bar nose extends outside the cheek plates over at least half the sprocket circumference, such that the saw chain passing over the sprocket goes entirely free from the plates and the rest of the bar. Means are arranged for supplying pressurized lubricant via the bar to the sprocket mounting. The lubricant pressure and the gaps between the side surfaces of the sprocket and the inner faces of the cheek plates are such that in operation lubricant passes out through the gaps. Means are also arranged for supplying flushing and cooling medium via the bar for ejection against the saw chain and sprocket both at the place where the chain meshes with the sprocket and at the place where the chain unmeshes with the sprocket. The saw chain (3) is preferably adapted to run free from the bar before and after meshing with the sprocket. Sawing work is thus carried out mainly by the chain supported by the sprocket. The sprocket (5) suitably has a diameter of a magnitude such that both parts of the saw chain converge in a direction away from the nose sprocket.

13 Claims, 3 Drawing Sheets

35
33
29
37
27
31
11
19
23
15
13
21
2
6
6
17
25
8
9
10
1
53
7
3
5
41
5
39

CHAIN SAW

TECHNICAL FIELD

The present invention relates to a chain saw for sawing in very hard and difficultly worked material such as concrete, the saw including a drive motor unit, a saw chain bar connected to the unit and an endless saw chain arranged to circulate round a drive sprocket in the drive motor unit and a nose sprocket which is rotatably mounted at the free nose end of the bar, the saw chain including cutting links provided with cutting elements, these links being held together with the aid of connecting links co-acting with the teeth on the drive and nose sprockets.

TECHNICAL BACKGROUND

Motor driven chain saws are often used in the building industry for making holes in walls and the like, which are made from timber or other easily worked materials. When it is a question of making holes in hard materials, such as concrete, it has been found that utilizing chain saws with success has not been possible. The reason for this seems to be the very difficult working conditions that are met with, inter alia due to the formation of dust, slurry, etc. which gives heavy wear, blockages and other problems which make great demands on the equipment utilized.

Instead, so-called core drills are often used, i.e. a large number of holes are drilled along the defining line of the opening it is desired to achieve, which is obviously laborious and expensive.

Hand-held so-called diamond saws are also used, these being hydraulically driven and water cooled, which requires separate extensive auxiliary equipment. Such a saw has an annular saw blade with an outer edge provided with cutting elements and which is mounted in a drive means at one side so that the saw blade can be caused to circulate, that is, to rotate about its axis. Work with this type of saw is extremely trying and the possible saw blade diameters and saw depths are heavily limited.

OBJECT OF THE INVENTION

The object of the present invention is to provide a chain saw enabling effective sawing in hard materials such as concrete and other difficultly worked materials, while at the same time keeping the saw simple, reliable, light and versatile to work with.

SUMMARY OF INVENTION

The above mentioned object is achieved by a chain saw having the distinguishing features disclosed in the accompanying claims.

The inventive chain saw is thus distinguished by it having a nose sprocket arranged between two cheek plates at the nose of the chain bar, the sprocket being rotatably mounted with the aid of a bearing arranged between the cheek plates. The inner spacing between the plates corresponds to the thickness of the nose sprocket, i.e. the spacing is somewhat greater so that solely mounting gaps are formed therebetween. The circumferential area of the nose sprocket with associated teeth at the nose or front end of the bar is outside the cheek plates for at least half the circumference of the nose sprocket, so that the saw chain passing over the sprocket is entirely free from the plates and the rest of the chain bar. In other words, hers the saw chain is in no way guided in or by the cheek plates, and only co-acts with the tooth area of the nose sprocket. In addition, there are means for supplying pressurized lubricant via the bar to the above-mentioned mounting. The lubricant pressure and the gaps which are thus to be found between the side surfaces of the nose sprocket and the inner surfaces of the cheek plates are such that in operation lubricant can pass out through the gaps. In this way dust, slurry etc. caused by sawing is prevented from penetrating into the gaps simultaneously as the passing saw chain is lubricated by the outwardly forced lubricant. Means are also arranged for supplying flushing and cooling medium via the bar for flushing the saw chain and co-acting parts of the nose sprocket clean and simultaneously providing required cooling and removal of material cut by the saw. This flushing and cooling medium, which is preferably water, is arranged for ejection against the saw chain and the nose sprocket at the place where the saw chain meshes with the nose sprocket and also at the place where the saw chain unmeshes with the nose sprocket.

It has been found that the above-mentioned combination of features provides a chain saw which functions extremely effectively, has very small wear, does not have any tendency to block up or be subjected to deposits or mounting problems due to the saw slurry which is formed. In addition, it can be made very thin with retained mechanical stability and simplicity.

The supply of pressurized lubricant to the mounting effectively protects the mounting simultaneously as the outwardly forced lubricant lubricates the saw chain precisely where it works. The supply of flushing and cooling medium where the saw chain meshes with the nose sprocket means that meshing takes place between clean-flushed details, which gives improved meshing and low wear, in Particular since lubricant is also entrained by the nose sprocket passing out from the space between the cheek plates. At the same time, a good supply of flushing and cooling medium is ensured to the whole of the working nose portion of the chain bar, even though it could be deep into a concrete wall, for example. The supply of further flushing and cooling medium where the chain unmeshes with the nose sprocket ensures flushing and cooling of the chain in direct connection to where its sawing work proper ceases, as well as clean-flushing of the sprocket before it passes between the cheek plates.

In accordance with the invention the sawing work proper takes place solely with the part of the chain which is supported by the "free" part of the nose sprocket. This means that the chain is preferably arranged for running freely from the saw bar, at least a substantial distance along the bar, before and after engaging with the nose sprocket, preferably completely freely between the drive and nose sprockets. In other words, the chain is not guided nor supported by the edges of the saw bar, which enables the bar itself to be made extremely simply. In principle, the bar can be an elongate flat element which is provided in a suitable way with conduits or ducts for lubricant and cooling and flushing medium and which is forwardly provided with the cheek plates surrounding the nose sprocket. The fastening portions of the cheek plates are suitably let into said flat element so that the outsides of the cheek plates are flush with the side surfaces of the flat element.

The embodiment with free, upper and lower side parts of the chain which normally do not perform any work gives great flexibility to the implementation of the chain bar itself. In particular, the nose sprocket can be given a comparatively large diameter, e.g. in the order of magnitude 20–30 cm, and both parts of the chain can converge from the nose sprocket to the drive sprocket. The large diameter of the nose sprocket means increased kerf length while at the same time the stresses due to the unavoidable bending of the chain about the nose sprocket will the less and the stability of the working chain supported by the nose sprocket will be better.

The backwardly converging bar configuration also means increased free space around the bar in the material in which sawing is being performed, which reduces the risk of seizing and facilitates run-off of saw, slurry etc.

It is emphasized that the saw bar nose configuration in accordance with the invention is very simple and can be very thin but even so it has excellent stability and strength for a large nose diameter as well. Mounting the nose sprocket can be made very simple. The mounting can thus quite simply comprise a central, circular, fixed boss such as a disc fixed between the cheek plates, which has an outer circular race, there being an inner circular race on the nose sprocket which constitutes the definition of a central hole therein, between said races there being arranged rolling elements such as balls or rollers. It has been found unnecessary to have any special keeper means for the rolling elements. It will be understood that for good journalling function and stability of the nose sprocket it is of importance that the cheek plates surround a very large part of the nose sprocket, i.e. in principle the whole of it with the exception of a peripheral area along the part which is in mesh with the saw chain.

It is thus essential for effective function of the saw chain in accordance with the invention that the working part of the chain is stabilized and well supported. Further to the mounting of the nose sprocket accounted for, the implementation of the saw chain itself is of importance. It has been found suitable to allow the cutting links of the chain to be substantially block-shaped, the lower part of the link being formed complemental to the tooth space between the teeth of the nose sprocket so that the cutting links, during their working pass over the bar nose, substantially constitute fixed projections of the nose sprocket. The cutting elements of the cutting links are to advantage substantially parallel-epipedic, the upper surface of the elements preferably being somewhat arched in the chain direction and the width of the elements somewhat greater than the distance between the outer faces of the cheek Plates. This distance is preferably the same as the rest of the bar thickness.

As will be understood from what has been said herein before, distinguishing for the chain saw in accordance with the invention is that the saw chain part supported by the nose sprocket is what provides the main sawing or cutting effect. This means that the saw can be caused to work in different ways, depending on what kind of hole it is desired to make. The saw can be utilized advantageously as a plunging cutter, i.e. the saw bar is fed in its longitudinal direction into the wall or the like for cutting, or the saw may be used to provide a long kerf with greater or less depth, the cutting nose portion of the bar either being caused to move itself in the direction of the desired kerf (with the saw bar suitably extending transversely relative the kerf) or being caused to move along a curved path in the plane of the kerf, suitably by the saw bar swinging about an axis extending through the drive motor unit. In accordance with a preferred embodiment, the chain saw is thus suspended in a stand structure such that it can be advanced both in the direction of the bar and transverse the bar direction, as well as being pivotable about an axis at right angles to said both directions, this axis preferably passing through the drive motor unit. There is thus obtained complete flexibility with regard to working attitudes of the saw.

It will be understood that the supply of lubricant as well as flushing and cooling medium can take place by suitable conduits coupled to the chain saw, suitably at the drive motor unit. The lubricant is suitably a lubricating oil and in accordance with the invention it is, however, preferred to arrange both a lubricant container and a pump on the drive motor unit itself, the pump being adapted for driving by the motor, which can be an electric motor, included in the drive motor unit.

By the chain saw in accordance with the invention to advantage having freely running and thus unguided parts, the chain bar is preferablY connected to the drive motor unit so that it is at least limitedly moveable in the longitudinal direction of the bar in relation to the drive motor, spring means being arranged to bias the saw bar away from the drive motor and thereby keep the chain tensioned.

In such a case the saw bar can be moveably mounted in the drive motor unti, with the drive motor itself with its drive sprocket being rigidly mounted in the drive motor unit, or vice versa. The spring bias can to advantage be progressively increasing for relative movement tending to decrease the saw chain tension. In this connection the term "spring" is to be considered as having a wide meaning, including a hydraulic flexing arrangement, for example.

Biasing the saw chain also signifies that the chain can take up shock stresses in the case of seizure. Furthermore, the risk of lateral casts of the free chain parts behind the nose sprocket is reduced. Finally, the cutting links will be kept even better in place in the tooth spaces on the nose sprocket.

Further distinguishing features of the chain saw in accordance with the invention %,ill be apparent from the following more detailed description of an embodiment of the chain saw preferred at present.

DESCRIPTION OF EMBODIMENT

Figure 1:
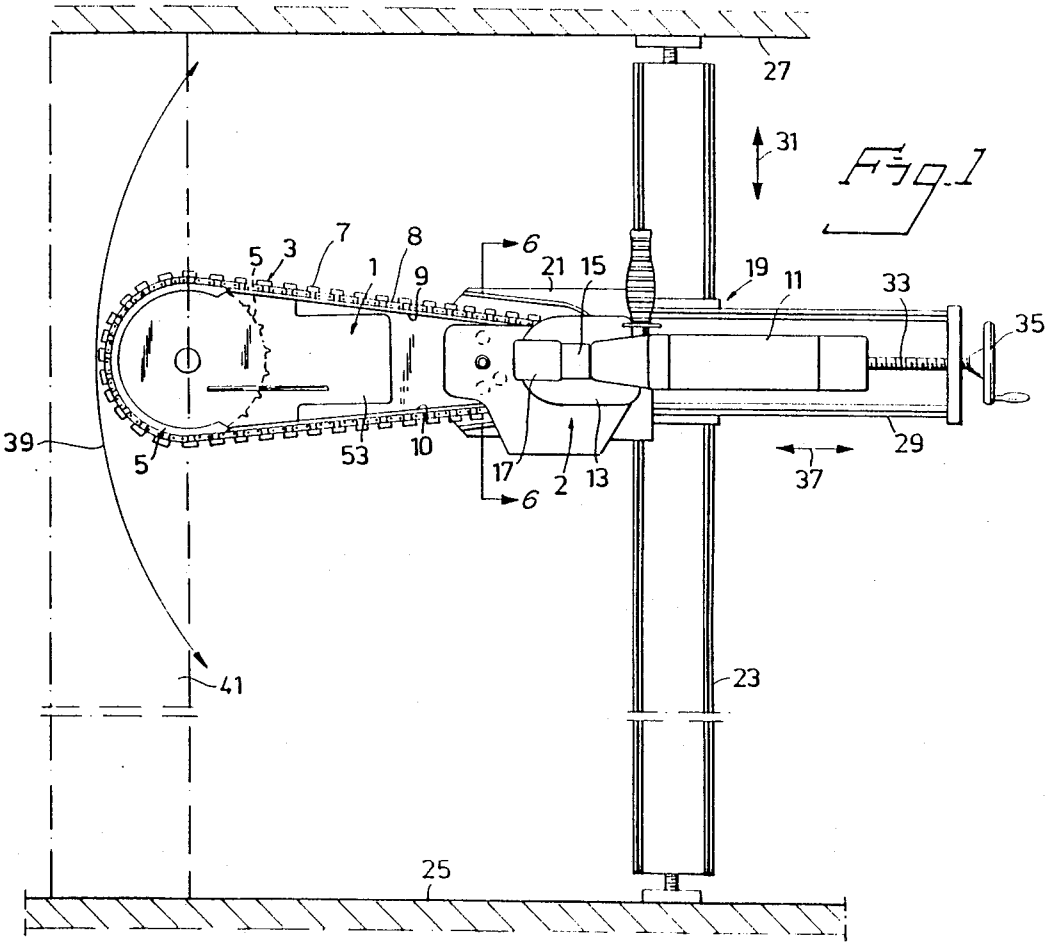
FIG. 1 is a schematic side view of an embodiment of a chain saw in accordance with the invention suspended in a stand fixed between floor and ceiling for sawing in a vertical wall.

The chain saw in accordance with the invention illustrated on the drawings comprises a chain bar 1, which is connected to a drive motor unit 2 and an endless saw chain 3. The saw chain 3 circulates over a freelY rotating nose sprocket 5 mounted on the front end of the chain bar 1 and an unillustrated drive sprocket conventionally arranged in the unit 2. The nose sprocket 5, which supports the working bar nose part of the saw chain, typically has a diameter of 20–30 cm, while the drive sprocket diameter is considerably less, e.g. about 10–12 cm. Both parts 7, 8 of the saw chain 3 between the two sprockets thus converge towards the drive motor unit. These converging parts 7, 8 run completely free from the saw bar 1, i.e. at small spacing from both longitudinal side edges 9, 10 of the bar itself. The implementation of the bar 1 will be accounted for in detail later with reference to FIG. 2.

The drive motor unit 2, which has a basically conventional implementation, includes an elongate electric motor 11 driving the drive sprocket via a gear box 13. An exteriorly mounted piston-type oil pump 15 is connected to the gear box 13 and is supplied with lubricating oil from a small adjacent oil container 17. The oil pump feeds pressurized oil via ducts in the drive motor unit to the chain bar 1 for further conveyance to the nose portion of the bar, as will be described in more de tail later. The motor 17 extends freely backwards from the drive motor unit part proper, and essentially parallel to the longitudinal direction of the bar 1.

The drive motor unit 2 is moveably suspended in a stand 19 via a mounting plate 21. The stand includes a vertical guide member 23 which can be clamped between the floor 25 and ceiling 27. The stand also includes a horizontal guide member 29 which is carried by the member 23 so that it is conventionally displaceable along the member 23 and can be locked (not more closely illustrated) at different heights, as illustrated by the double arrow 31. The mounting plate 21 is carried by the guide member 29 so that it is controllably displaceable along this member with the aid of a screw 33 and a wheel 35, and is also controllably pivotable about an axis at right angles to the plane of the paper in FIG. 1 and which passes through the drive motor unit proper. The first-mentioned displaceability is illustrated by the double arrow 37 while pivotability is illustrated by the double arrow 39. The implementation of pivotability is not illustrated since it should bs obvious to one skilled in the art how this can be suitably arranged.

It will be understood that the described stand configuration enables achieving optional saw cuts in a vertical plane in a concrete wall (here only indicated at 41). There is thus enabled plunge sawing with changes in height between each plunge saw cut (the depth of which is only limited by the length of the chain bar and the arrangement for horizontal advance of the bar) or arcuate sawing as indicated by the arrow 30 in FIG. 1. In this case there is an advancing movement along the guide member 29 after each circular cut, which suitably takes place from above and downwards while utilizing the effect of gravity for the downward advancing movement. For this purpose the chain saw can suitably be balanced while utilizing the rearward projection of the motor 11.

It will be further understood that a stand of the kind described could be mounted with the guide member 23 horizontal, i.e. clamped between two walls, for example optional saw cuts then being achieved in a corresponding manner in a horizontal plane. Other directions for the guide member 23 are also possible, of course. Similarly, the chain saw could be mountable in the horizontal guide member such that the chain bar plane is also horizontal. In this way it would be very easy to provide plunge cuts connecting up to each other but mutually at right angles, i.e. to achieve squarecut corners when making a door, window or other opening in a wall, even if the wall is thick.

It can be generally established that the chain saw in accordance with the invention enables the exact achievement of the opening or cut which is desired, and this alone, with a minimum of sawing work. In this connection, it is of course of great importance with thin kerfs and the possibility of obtaining correct corners. The embodiment with a cutting or working nose part with an "enlarged diameter" in combination with the moveable suspension of the chain bar means that it will also be possible to put saw cuts close to any obstruction or limitations, since the bar can be advanced with its axis forming a given angle to the advancing direction, i.e. only the nose portion itself moves along the obstruction or limitation in question.

The implementation of the chain bar and its connection to the drive motor unit will now be described in more detail with reference to FIGS. 2–6.

The main part of the chain bar 1 is a solid, thin plate 43 of hard aluminium, at its rear end adapted for connecting to the drive motor 2 such that the bar is limitedly moveable in its longitudinal direction relative the unit. The rear end of the plate 43 is thus controllably displaceably arranged between the mounting plate 21 and one side of a base plate 45, on the other side of which the gear box 13 is connected. The unillustrated drive sprocket is mounted on the abovementioned one side of the base plate 45 so that the sprocket is in the same plane as the chain bar. Guiding of the bar plate 43 is ensured by two elongate recesses 47 in the longitudinal direction of the bar in the plate 43, guide bolts 49 extending through these recesses. As will be understood, the length of the recesses 47 determines the amount of movement the bar can have relative the drive motor unti 2. The necessary spring bias required for tensioning the saw chain 3 is obtained by spring means 51, which are only schematically indicated in FIG. 2, and which engage against the rear end of the plate 43 and an unillustrated stop in the drive motor unit. In order that the weight of the saw will be as small as possible the plates 21 and 25 and the housing of the gear box 13 are made from light metal such as aluminium.

Two thin but stiff cheek plates 53, 54 of stainless steel are attached forwardly on the concavely rounded-off chain bar plate 43. The rear attachment parts of the cheek plates are fastened in complemental recesses on either side of the plate 43 so that the outer faces of the cheek plates 53, 54 are flush with the side surfaces of the plate 43. The freely projecting forward parts of the cheek plates mutually form an inner mounting gap space 55 for the nose sprocket 5. These forwardardly projecting parts thus have a substantially circular configuration corresponding to the diameter of the nose sprocket 5. However, the forward parts have a restricted size such that the forward tooth or peripheral area of the nose sprocket projects freely out of the space 55 between the cheek plates in the region of somewhat more than half the circumference of the nose sprocket. Also, the diameter of the nose sprocket 5 is greater than the greatest width of the forwardly diverging plate 43 which is extended by the cheek plates 53, 54. In this way it is ensured that the saw chain 53 passing over the free peripheral or tooth area of the nose sprocket 5 is free from the plate 43 and the extended cheek plates 53, 54 on meshing and unmeshing with the nose sprocket.

The nose sprocket 5 is annular and centrally mounted on a stainless steel bearing disc 57 rigidly fastened between the cheek plates 53, 54. Journalling is ensured by rollers 59 freely placed between the outer circumferential race 61 on the plate 57 and the inner circumferential race 63 of the nose sprocket 5. The width of the mounting space 55 corresponds to the nose sprocket thickness, such as to solely form lateral mounting gaps 65, 66 (exaggerated in FIGS. 3 and 4) between the side surfaces of the nose sprocket 5 and the inside faces of the cheek plates 53, 54. Very stable mounting of the nose sprocket 5 is thus ensured, this mounting inter alia preventing the sprocket from being deformed in some way in connection with loading from the saw chain, in spite of the very thin bar configuration. The plate 43 may have a typical thickness of about 6 mm.

Pressurized lubricating oil is supplied to the mounting space 55 in the vicinity of the bearing rollers 59 to ensure good bearing function and simultaneously prevent saw slurry penetrating into the bearing. Since the oil is pressurized, it passes out through the lateral gaps 65, 66, thus simultaneously lubricating the gap walls and entraining possible contaminants trying to penetrate into the gaps. Once out of the gaps, the oil lubricates the teeth on the sprocket 5 and the chain 3 passing over them.

The lubricating oil is supplied via a tube 69 which is recessed into one cheek plate 53 and in communication with a bored duct 71 in the bar plate 43. The tube 69 is flattened for recessing into the plate 53 but in spits of this it has a sufficient interior cross section. The duct 71 extends to the rear end of the plate 43 where it has a side opening 73 on the side of the plate 43 facing towards the oil pump 15. This opening 73 is directly opposite an oil duct in the plate 45. The oil duct, which has a corresponding elongate opening for taking into account the limited displaceability of the chain bar, is indicated at 75 in FIG. 6. The oil duct is supplied with pressurized oil from the oil pump 15.

Figure 2:
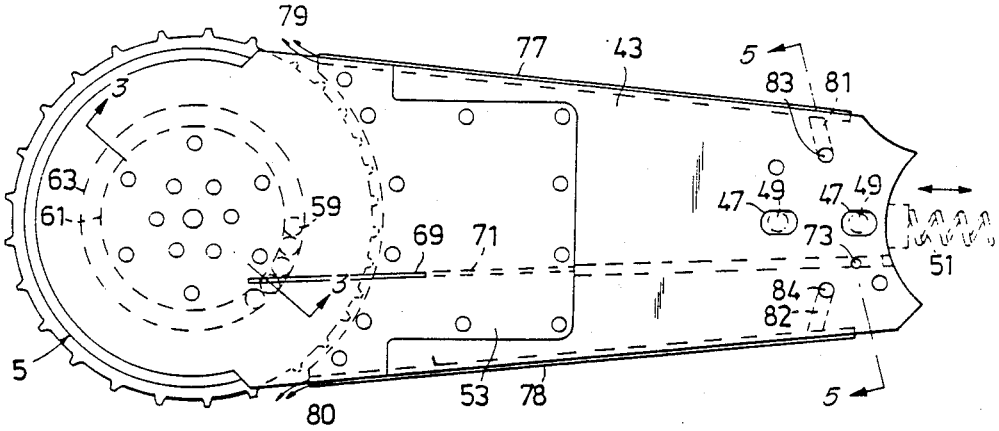
FIG. 2 is a schematic side view of the chain bar included in the chain saw according to FIG. 1.
Figure 3:
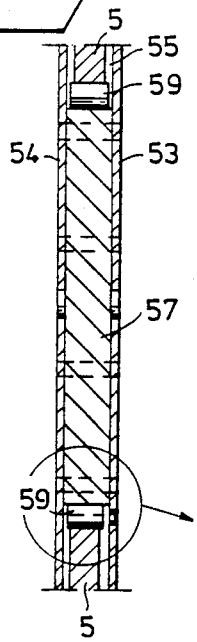
FIG. 3 is a partial cross-sectional view taken along the line III—III in FIG. 2.
Figure 5:
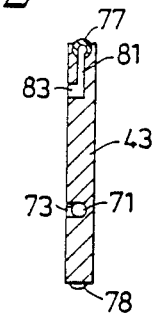
FIG. 5 is a cross-sectional view of the chain bar taken along the line V—V in FIG. 2.
Figure 4:
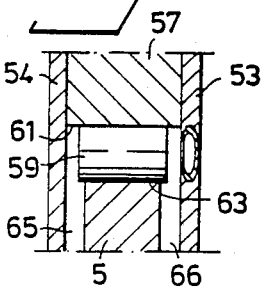
FIG. 4 is an enlarged, partial cross-sectional view more closely illustrating how lubricant is supplied to the bearing in FIG. 3.
Figure 6:
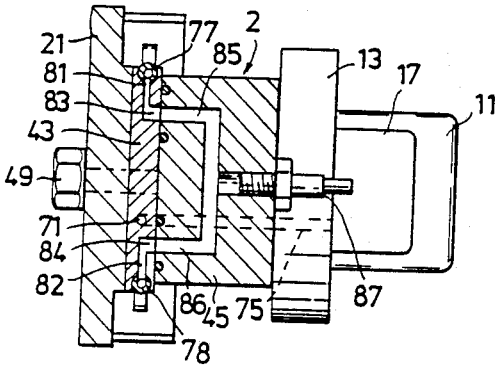
FIG. 6 is a schematic cross-sectional view of the chain saw taken along the line VI—VI in FIG. 1.

The chain bar is also adapted for supplying flushing and cooling medium, preferably water, to the areas where the saw chain starts to mesh or unmesh with the nose sprocket 5. Water tubes 77, 78 extending substantially along the entire length of the plate are let into both side edges of the plate 43 for this purpose. Forwardly, the tubes open out so that water is ejected into the areas where the tooth area of the nose sprocket 5 goes out of and into the mounting space 55, respectively. The water jets are illustrated in FIG. 2 by arrows 79, 80. Backwardly, the tubes 77, 78 connect to associated inwardly directed ducts 81, 82 inside the plate 43. The ducts open out in side openings 83, 84, which in substantially the same way as the oil duct opening 73 sealingly connects to corresponding ducts 85, 86 in the plate 45. These latter ducts are connected to a water pipe union 87 on the outside of the plate 45.

Figure 7:
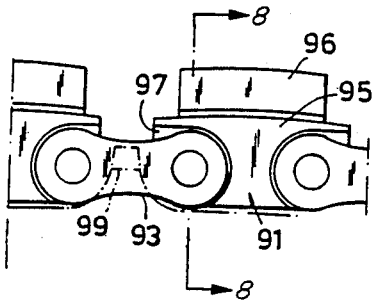
FIG. 7 is a schematic, partial side view illustrating the implementation of the saw chain.
Figure 8:
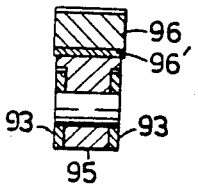
FIG. 8 is a cross-sectional view of the saw chain taken along the line VIII—VIII in FIG. 7.

The configuration of the saw chain 3 and its meshing with the nose sprocket 5 are illustrated in FIGS. 7 and 8. The chain comprises cutting links 91 connected by flat side connection links 93. The cutting links have a block-like lower part 95 with a cutting element 96 rigidly mounted thereon, the cutting element being substantially parallel-epipedic and impregnated with diamonds with exception of the lowest part 96', with which the cutting element is fastened to the lower part 95 and having a width somewhat exceeding the thickness of the chain bar plate 43. The upper side of the cutting element 96 is somewhat convex for adapting to the curvature of the nose sprocket.

On its under side and end surfaces the lower part 95 is implemented complementary to the toothspaces on the nose sprocket, so that a good fit is obtained.

The respective ends of the connecting links 93 are mounted in corresponding side recesses 97 in the lower parts 95 so that the outsides of the links 93 are flush with the side surfaces of the lower parts 95. The internal spacing between the links 93 corresponds substantiallY to the lower width of the teeth 99. Together with the previously mentioned complemental configurations cf tooth space and cutting link, the combination of chain and sprocket in mesh will be extremely stable and will have a uniform configuration which gives good cutting ability, and which due to the effective flushing and oil lubrication of the chain and sprocket gives small wear, the risk of operational disturbance due to blockages or deposits also being avoided to a substantial degree.

Hereinbefore there has been described an embodiment of the chain saw in accordance with the invention, which is provided with a saw chain suitable for sawing in concrete. In the building industry other difficultly worked materials are encountered, however, such as brick and composite material of the type to be found in partitions of so-called cloison-kind. It can be advantageous to utilize other kinds of cutting elements in such materials instead of the diamond impregnated cutting elements 96. Carbide cutting elements can be suitably used in such cases. It has bee n found particularly advantageous to have cutting elements of the kind, and with the special arrangements described in the Swedish Patent No. SE 7705515-0 (publication number 427 739) now referred to. The lower parts 95 of the cutting links correspond here to the drill pipe end wall in said Swedish Patent.

We claim:

1. In a chain saw for sawing in very hard material, comprising a drive motor unit, a chain bar connected thereto and an endless saw chain arranged to circulate over a drive sprocket in the drive motor unit and a nose wheel which is rotatably mounted at a free nose end of the bar, the chain including cutting links equipped with cutting elements and connected together with the aid of coupling links, said links co-acting with the drive sprocket and the nose wheel, the improvement of:

(a) the nose wheel is arranged between two cheek plates at the nose end of the bar while rotatably mounted on a bearing arranged between said plates, an interior spacing between the plates corresponding to the thickness of the nose wheel, a peripheral area of the nose wheel forward of the chain bar being outside the cheek plates for at least half the nose wheel circumference, such that the saw chain passing thereover goes entirely free from the cheek plates and the rest of the bar, (b) means are arranged for supplying pressurized lubricant to said bearing via the bar, the lubricant pressure and gaps between the side surfaces of the nose wheel and inner faces of the cheek plates being such that in operation lubricant passes out through the gaps, thereby preventing dust and slurry occurring during sawing from penetrating into the gaps, as well as lubricating the passing saw chain, (c) means are arranged for supplying flushing and cooling medium via the bar, such that the medium is ejected towards the saw chain and the nose wheel both at a place where the chain meshes with the wheel and at a place where the chain unmeshes with the wheel, (d) the saw chain is adapted to run free from the chain bar at least for a substantial distance along the bar before and after meshing with the nose wheel, (e) two side parts of the chain converge in a direction from the nose wheel to the drive sprocket, and (f) the chain bar is connected to the drive motor unit such that the bar is at least limitedly movable in the direction of the bar relative the drive motor unit, there being spring means arranged for biasing the bar in a direction away from the drive motor unit for keeping the chain tensioned.

2. Chain saw as claimed in claim 1, wherein said bearing comprises a central boss having an outer circumferential race, and an inner circumferential race on the nose wheel constituting definition of a central hole in said wheel, and rolling elements between said races.

3. Chain saw as claimed in claim 1, wherein the cutting elements of the cutting links are substantially parallel-epipedic, and the width of the elements are somewhat greater than the distance between the outer faces of the cheek plates, said distance being equal to the thickness of the remainder of the chain bar.

4. Chain saw as claimed in claim 1, wherein the nose wheel is a sprocket having a tooth space between adjacent teeth, and the cutting links of the saw chain are substantially block-shaped, with the lower link part shaped complemental to said tooth space, so that the cutting links substantially constitute solid projections on the nose sprocket as the chain passes round the nose end of the bar.

5. Chain saw as claimed in claim 2, wherein the nose wheel is a sprocket having a tooth space between adjacent teeth, and the cutting links of the saw chain are substantially block-shaped, with the lower link part shaped complemental to said tooth space, so that the cutting links substantially constitute solid projections on the nose sprocket as the chain passes round the nose end of the bar.

6. Chain saw as claimed in claim 3, wherein the nose wheel is a sprocket having a tooth space between adjacent teeth, and the cutting links of the chain are substantially block-shaped, with the lower link part shaped complemental to said tooth space, so that the cutting links substantially constitute solid projections on the nose sprocket as the chain passes round the nose end of the bar.

7. Chain saw as claimed in claim 1, wherein the drive motor unit includes an electric motor, which drives both the drive sprocket and a lubricant pump, said pump being adapted for feeding said lubricant supply means with pressurized lubricant.

8. Chain saw as claimed in claim 1, comprising stand means for suspending the drive motor unit and the chain bar so as to be advancable in the saw bar direction and transverse the saw bar direction, and so as to be pivotable about an axis at right angles to said two directions.

9. Chain saw as claimed in claim 2, comprising stand means for suspending the drive motor unit and the chain bar so as to be advancable in the bar direction and tranverse the saw bar direction, and so as to be pivotable about an axis at right angles to said two directions.

10. Chain saw as claimed in claim 3, comprising stand means for suspending the drive motor unit and the chain bar so as to be advancable in the saw bar direction and transverse the saw bar direction, and so as to be pivotable about an axis at right angles to said two directions.

11. Chain saw as claimed in claim 1, wherein the two side parts of the chain run unsupported by the edges of the saw bar.

12. Chain saw as claimed in claim 2, wherein the two side parts of the chain run unsupported by the edges of the saw bar.

13. Chain saw as claimed in claim 3, wherein the two side parts of the chain run unsupported by the edges of the saw bar.

* * * * *